US006769992B1

(12) United States Patent
Domulevicz et al.

(10) Patent No.: US 6,769,992 B1
(45) Date of Patent: Aug. 3, 2004

(54) ASSEMBLY AND METHOD FOR CUT SHOOTING A POOL BALL

(76) Inventors: Mark D. Domulevicz, 2448 N. Hazelwood Ct., Wichita, KS (US) 67205; Jeffrey L. Fetter, 2013 N. Grace Ave. Ct., Andover, KS (US) 67002

( * ) Notice: Subject to any disclaimer, the term of this patent is extended or adjusted under 35 U.S.C. 154(b) by 0 days.

(21) Appl. No.: 10/298,858

(22) Filed: Nov. 18, 2002

(51) Int. Cl.[7] ..... A63D 15/00
(52) U.S. Cl. ..... 473/2
(58) Field of Search ..... 473/1, 2, 5, 17, 473/44, 52, 219, 220

(56) References Cited

U.S. PATENT DOCUMENTS

| | | | | |
|---|---|---|---|---|
| 4,027,883 A | | 6/1977 | Batori | |
| 4,120,494 A | * | 10/1978 | Roe | 473/2 |
| 4,337,943 A | | 7/1982 | Stewart | |
| 4,688,796 A | | 8/1987 | Wright | |
| 4,882,676 A | * | 11/1989 | Van De Kop et al. | 473/2 |
| 5,275,398 A | | 1/1994 | Compton | |
| 5,338,262 A | | 8/1994 | Hayes | |
| 5,472,204 A | | 12/1995 | English et al. | |
| 5,527,036 A | | 6/1996 | Hutchings et al. | |
| 5,554,075 A | * | 9/1996 | Glazer | 473/2 |
| 5,738,595 A | * | 4/1998 | Carney | 473/209 |
| 5,818,036 A | | 10/1998 | Daly | |
| 5,919,095 A | | 7/1999 | Risner | |
| 5,964,668 A | | 10/1999 | Tai et al. | |
| 6,004,230 A | | 12/1999 | Hooker | |
| 6,017,277 A | | 1/2000 | Chuang | |
| 6,036,608 A | | 3/2000 | Morris | |

FOREIGN PATENT DOCUMENTS

GB 2184221 A * 6/1987 ..... 473/2

* cited by examiner

*Primary Examiner*—Gregory Vidovich
*Assistant Examiner*—Mitra Aryanpour
(74) *Attorney, Agent, or Firm*—Kenneth H. Jack; Davis & Jack, LLC

(57) ABSTRACT

An assembly and method for performing a pool cut shot upon a pool table having a pocket, the assembly including a ball spotting laser supported by a frame, a table spotting laser also supported by the frame and laser mounting brackets orienting the ball spotting and table spotting lasers upon the frame so that upon operation of the ball spotting laser to illuminate a ball strike point upon a pool ball, the table spotting laser automatically illuminates a cut shot target point upon the pool table's surface, the method including steps of utilizing the assembly to illuminate the cut shot target point, and shooting a cue ball to roll over the illuminated cut shot target point, striking the pool ball at the ball strike point, and driving the pool ball into the pocket.

8 Claims, 11 Drawing Sheets

ASSEMBLY AND METHOD FOR CUT SHOOTING A POOL BALL

FIELD OF THE INVENTION

This invention relates to the game of pool or pocket billiards. More particularly, this invention relates to assemblies, and methods which assist in the training of pool players in performance of "cut shots".

BACKGROUND OF THE INVENTION

One of the objects of the game of pool or pocket billiards is to utilize a pool cue to propel a cue ball over a pool table's surface into contact with a pool ball, driving the pool ball forwardly into one of the pool table's pockets. When a cue ball successfully drives a pool ball into a pocket, the cue ball typically strikes the pool ball at a ball strike point prescribed by geometries of the ball and the table. Since cue balls and pool balls are typically commonly sized, having equal diameters, the ball strike point is typically located on the surface of the pool ball, and is further located a distance above the pool table's surface equal to the radius of the pool ball. The proper ball strike point is further located by a flat vertical reference plane which bisects the pool ball and which extends forwardly from the pool ball to intersect the opening of the pocket into which the pool ball is to be driven. The proper ball strike point lies within such reference plane and on the rearward side of the pool ball. The proper ball strike point remains the same regardless of whether the cue ball is to be driven in an angled cut shot or a straight "in line" shot.

Where an "in line" shot is to be performed, the pool player may cause the cue ball to properly strike the pool ball at the ball strike point by aiming a pool cue stroke so that the pool cue drives the cue ball directly toward the center of the pool ball. Accordingly, where an "in line" shot is to be performed, the profile of the pool ball itself provides a useful aiming target.

In contrast, where an angled cut shot must be performed, the profile of the pool ball ceases to provide a useful aiming target. In performing a cut shot, neither the pool ball to be struck, nor any visible feature of the pool table serves as a useful aiming target. Accordingly, in performing a pool cut shot, a pool player must undesirably aim a pool cue stroke to drive the cue ball toward a target point which is not defined by any visible structure or indicia.

The instant inventive assembly and method for cut shooting a pool ball solves or ameliorates the above described drawback or difficulty by providing assemblies and method steps which result in illumination of a concise, visible point upon the pool table's surface, such illuminated point serving as a cut shot target point.

Through repeated use of the instant inventive assembly and method, a novice pool player may become better able to perform cut shots without the provision of an illuminated cut shot target point.

BRIEF SUMMARY OF THE INVENTION

A major structural component of the assembly of the instant invention comprises a support frame for elevating, holding and pointing light beam emitters, preferably lasers. Preferably, the support frame comprises an enlarged base having a columnar hollow housing extending upwardly therefrom, the preferred lasers each being supported thereon in a double shear fashion by laterally opposed side walls of the columnar housing. Suitably, the upwardly extending portion of the frame may alternately comprise a single bar or post which supports the lasers in a cantilevered fashion.

The geometry explaining the function of the assembly of the instant invention is best envisioned with reference to a vertically oriented plane extending perpendicularly upwardly from a pool table's surface. Such reference plane vertically bisects a pool ball resting upon the table surface and extends forwardly from the pool ball to intersect the opening of a pocket into which a pool ball is to be driven. The frame preferably supports a ball spotting laser at an elevation above the pool table's surface and, preferably, the frame is positionable so that a rearward extension of the reference plane from the pool ball may bisect the ball spotting laser. As a result of such positioning, a ball spotting laser light beam emitted by the ball spotting laser will extend within the reference plane. Preferably, the frame is further positionable, or the ball spotting laser is pivotally positionable within the frame, so that the ball spotting laser beam may extend to and illuminate the pool ball at the ball strike point.

The laser supporting frame preferably similarly supports a table spotting laser over the table surface so that the above described reference plane similarly bisects the table spotting laser, causing a table spotting laser beam emitted by the table spotting laser to similarly extend within the reference plane. The table spotting laser preferably points downwardly and forwardly at an acute angle from vertical, and directly toward a proper cut shot target point on the table surface. The cut shot target point necessarily lies within the reference plane, and is positioned rearwardly from the resting point of the pool ball a distance equal to the diameter of the pool ball.

Provided that the frame raises the table spotting and ball spotting lasers to elevations above the pool ball, the frame may acceptably hold the table spotting laser at varying locations within the above described reference plane. For example, the frame may acceptably hold the table spotting laser at elevations above or below the ball spotting laser, the frame may acceptably positively and forwardly offset the table spotting laser away from the ball spotting laser, or the frame may acceptably negatively and rearwardly offset the table spotting laser away from the ball spotting laser. Regardless of the frame's placement of the table spotting laser within the reference plane, the following equation expresses the angular orientation of the table spotting laser in terms of the angular orientation of the ball spotting laser:

$$\beta = \tan^{-1}\left(\frac{(b-r)\tan\alpha - r - o}{t}\right),$$

where β equals the acute angle between a vertical line extending through the table spotting laser and a table spotting laser beam emitted by the table spotting laser, where b equals the elevation of the ball spotting laser over the table surface, where r equals the radius of the ball, where α equals the acute angle between a vertical line extending through the ball spotting laser and a ball spotting laser beam emitted by such laser, where o equals any positively forward or negatively rearward offset of the table spotting laser away from the vertical line extending through the ball spotting laser, and where t equals the elevation of the table spotting laser over the table surface. Conversely, the preferred angular orientation of the ball spotting laser may be expressed in terms of the angular orientation of the table spotting laser as follows:

$$\alpha = \tan^{-1}\left(\frac{t\tan\beta + r + o}{b - r}\right),$$

all variables being defined as stated above. Preferably, the lateral offset o equals zero, the preferred frame holding the ball spotting and table spotting lasers in vertical alignment. Also preferably, the frame holds the ball spotting laser above the table spotting laser so that their laser beams do not cross. α and β, as defined above, comprise a pair of angles which, when allowed to control the angular orientations of the ball spotting and table spotting lasers, assures illumination of the cut shot target point upon illumination of the ball strike point.

In operation of the assembly described above, and assuming that the frame rigidly holds the ball spotting and table spotting lasers in orientations as described above, the table spotting laser is turned on, and the frame is placed and positioned on the pool table's table surface so that a ball spotting laser beam emitting therefrom is directed to the ball strike point upon a pool ball resting upon the table surface. The frame is then further positioned and aligned so that ball spotting laser beam extends forwardly within the reference plane described above. Thereafter, the table spotting laser is actuated, causing its table spotting laser beam to automatically illuminate the proper cut shot target point upon the table surface. The frame may be alternately configured so that it rests upon and extends upwardly from a floor surface. Alternately, the frame may be configured to rest upon the pool table's raised side rail surface. The structures, geometries, and positioning steps discussed above are equally applicable to such alternate frame configurations.

Upon laser illumination of the cut shot target point, a novice pool player aims a pool cue stroke to drive a cue ball so that the cue ball rolls over the illuminated cut shot target point, resulting in proper striking of the pool ball at the ball strike point, driving the pool ball forwardly into the pocket.

Where the assembly of the instant invention consists exclusively of ball spotting and table spotting lasers supported by a frame, difficulties and inaccuracies may arise in aligning laser beams emitted by such lasers so that they extend within the above described reference plane, and further difficulties may arise in accurately pointing the ball spotting laser at the ball strike point. Such inaccuracies in aligning and pointing the lasers tend to cause the inventive assembly to illuminate a misplaced cut shot target point. In order to assist in achieving proper alignment of the ball spotting and table spotting lasers, a third laser having a fan beam collimation lens is preferably mounted upon the frame, such laser being oriented so that its beam fans vertically in alignment with light beams emitted by the ball spotting and table spotting lasers. In operation, such fanning and line drawing laser appears to draw an illuminated vertical line across structures such as the pool ball and the back wall of the pocket into which the pool ball is to be driven. Preferably, such line drawing laser is raised by the frame to an elevation allowing its fan beam to simultaneously draw vertical lines over the pool ball and over the back wall of the pocket. By aligning the frame so that such fan beam appears to draw a line which vertically bisects the pool ball, and which simultaneously intersects the pocket into which the pool ball is to be driven, proper alignment of the ball spotting and table spotting lasers is assured.

In order to assist in pointing the ball spotting laser at the ball strike point, a second line drawing laser, similarly having a fan beam collimation lens is preferably provided. Such second line drawing laser is preferably supported by a frame so that its beam fans horizontally at an elevation above the pool table's table surface, such elevation being equal to the radius of the pool ball. Just as the properly aligned vertical line drawing laser appears to draw a line which vertically bisects the pool ball, the horizontal fan beam of such second line drawing laser appears to draw a line which horizontally bisects the pool ball. The intersection of such two bisecting lines accurately pre-illuminates the ball strike point. Upon pre-illumination of the ball strike point, the frame may be accurately manipulated to cause the ball spotting laser beam emitted by the ball spotting laser to further illuminate the ball strike point.

Preferably, the base of the frame is segmented, allowing a lower section of the base to support the horizontal line drawing laser, such segmentation allowing an upper section of the base of the frame to be alternately stacked upon the lower section, or placed upon the rail of the pool table. Where such segmented base configuration is adopted, the vertical dimension of the lower section of the base is necessarily equal to the elevation of the pool table's side rail over the pool table's surface.

The assemblies discussed and described above perform acceptably in pool cut shot training situations where the novice pool table is free to position the pool ball. However, where the inventive assembly is used to facilitate cut shot training during game play, situations may arise where the proper location of the frame, as described above, coincides with the location of another pool ball upon the table surface, or conflicts with other structures. In order to allow the inventive assembly to be effectively used during game play, the ball spotting and table spotting lasers are preferably pivotably mounted upon the frame, their axes of pivotal motion being perpendicular to the above described reference plane. Also preferably, a variable motion linkage interconnecting the ball spotting and table spotting lasers is provided, such linkage being adapted to assure that the angular orientations of the ball and table spotting lasers relate to each other in accordance with the equations set forth above.

A simple form of such variable motion linkage is manually executed by an operator or pool player, such operator directly pivoting the ball and table spotting lasers to radially align with prescribed visible indicia upon the frame or with tactilly detectable detents upon the frame, such indicia or detents being oriented so that they guide motions of the ball spotting and table spotting lasers in accordance with the equations set forth above.

Preferably, the variable motion linkage between the ball spotting and table spotting lasers provides continuous variability, facilitating alignment of the ball and table spotting lasers in a multiplicity of pairs of angles α and β, each pair of angles relating to each other in accordance with the equations set forth above. The preferred continuously variable linkage advantageously lessens the constraints imposed by the geometry of the frame upon the required positioning of the frame.

A preferred continuously variable motion linkage comprises a cam and slide pin sub-assembly. Numerous other sub-assemblies for facilitating continuously variable angular motion of the ball and table spotting lasers may be utilized such as slide track and slide block assemblies, roller track and roller assemblies, slide slot and slide pin assemblies, paired non-circular gear assemblies, paired non-circular friction wheel assemblies, and computer controlled servo motor assemblies.

By pivotally mounting the ball and table spotting lasers upon the frame, and by providing a variable motion linkage which assures continuous proper angular orientation of the lasers, a ball spotting laser beam emanating from the ball spotting laser may be pointed at the ball strike point by pivotally moving the ball spotting laser with respect to the frame rather than forwardly and rearwardly moving the entire frame. The preferred segmented base configuration discussed above in relation to a fixed laser frame is equally applicable to the more preferred frame which supports the preferred pivotally mounted lasers.

Accordingly, it is an object of the present invention to provide structural assemblies and method steps as described above which assist in performance of pool cut shots through illumination upon a pool table's surface of a cut shot target point.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
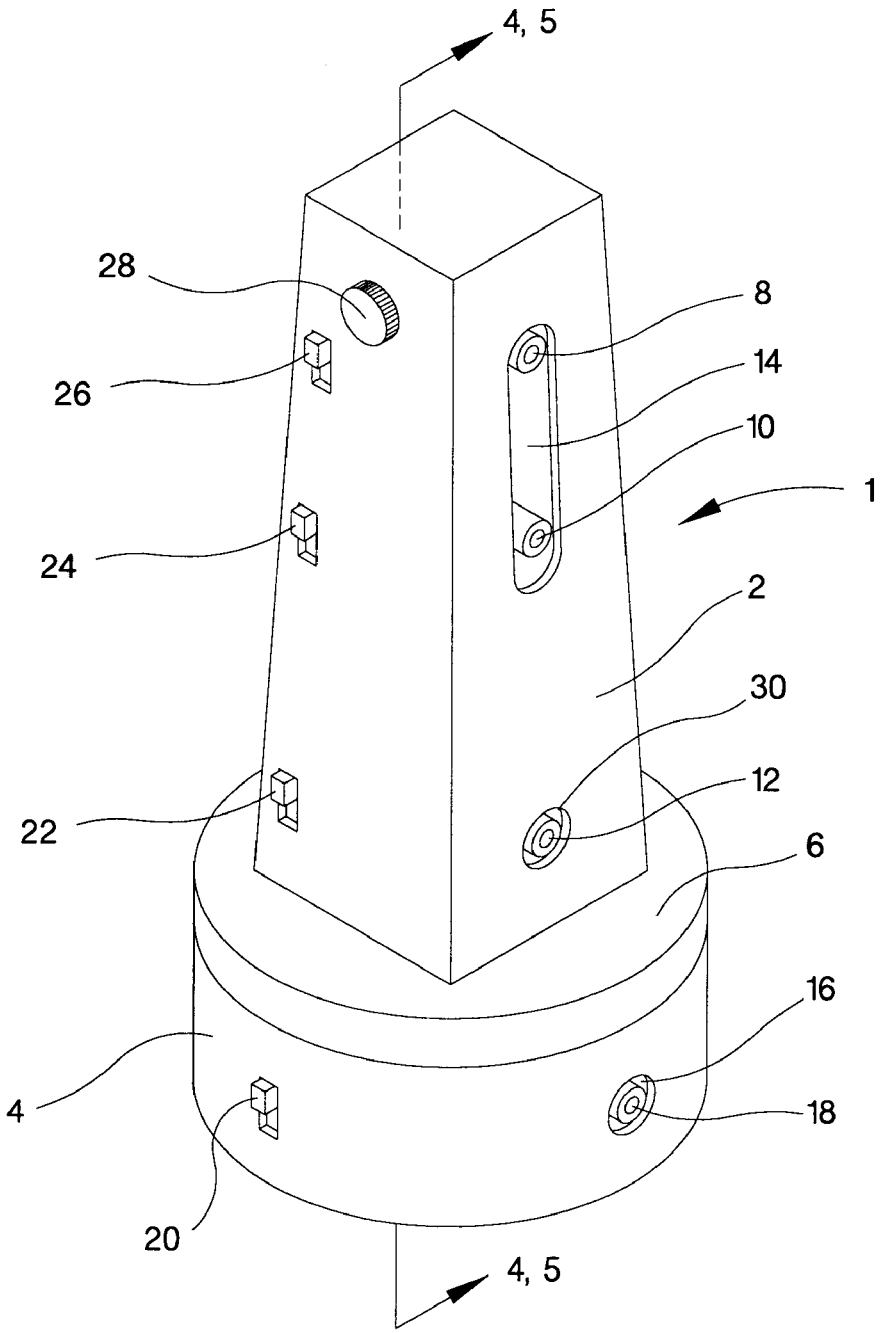
FIG. 1 is an isometric view of a preferred embodiment of the assembly of the instant inventive assembly and method.
Figure 2:
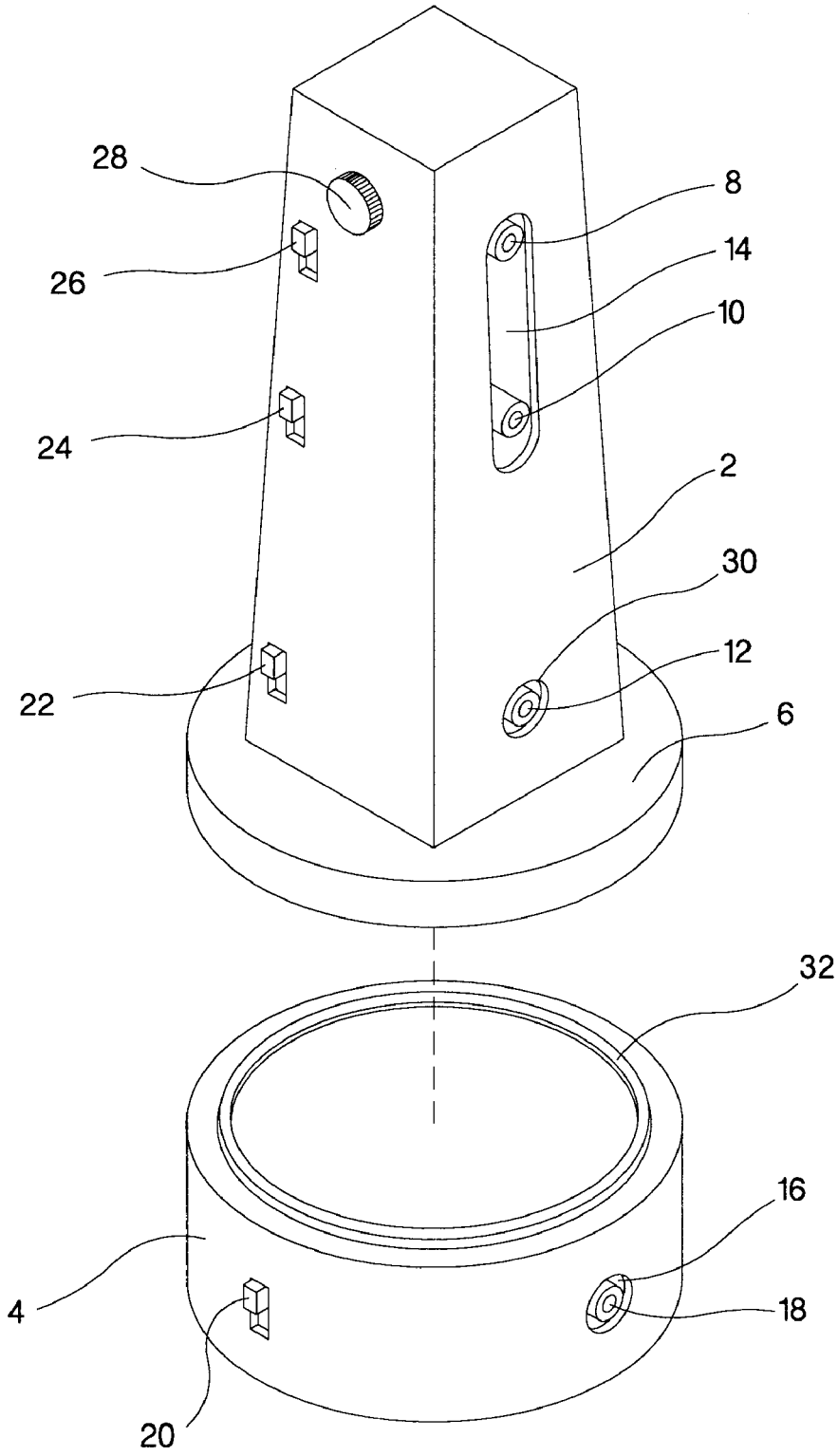
FIG. 2 is a partially exploded view of the assembly of FIG. 1.
Figure 3:
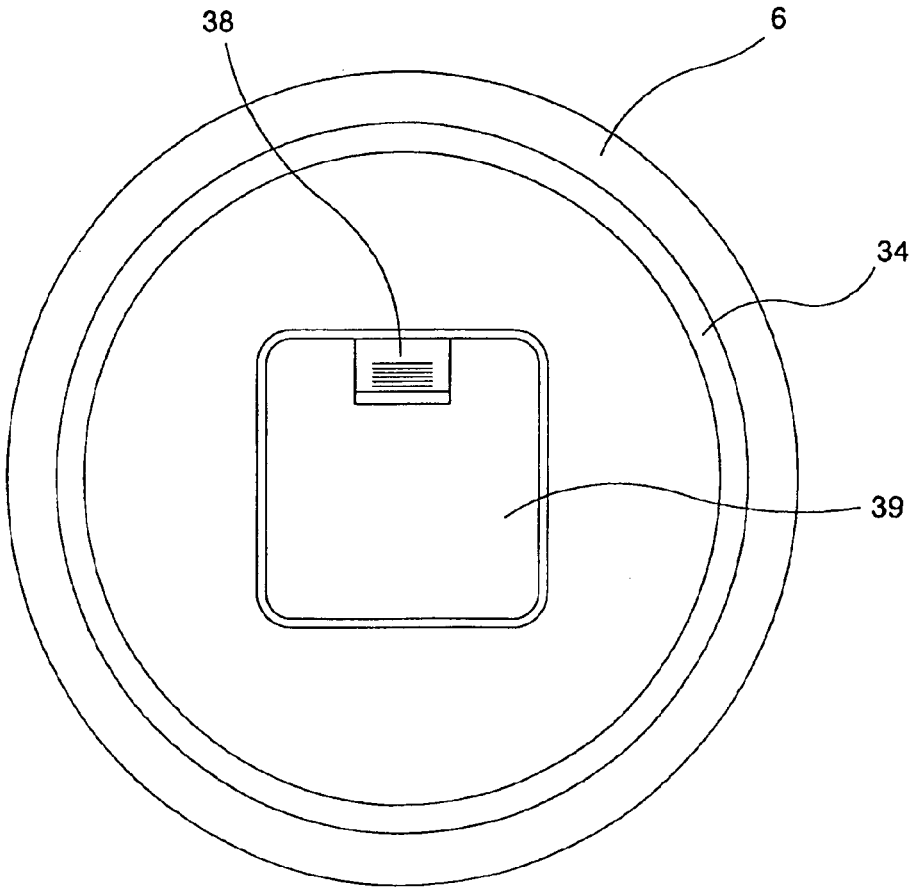
FIG. 3 is a bottom view of the upper segment of the base of the assembly depicted in FIG. 2.

Referring now to the drawings, and in particular to FIG. 1, a preferred embodiment of the assembly of the instant invention is referred to generally by Reference Arrow 1, such assembly comprising a laser supporting framework including a hollow columnar tower 2, an upper base 6, and a lower base 4. Preferably, the tower 2 is fixedly and rigidly attached to the upper surface of the upper base 6, and preferably the upper base 6 is removably mounted upon the upper surface of the lower base 4. Referring simultaneously to FIGS. 1–3, the upper surface of the lower base 4 preferably has an annular upwardly extending ridge 32, such ridge 32 nestingly extending into an annular ridge receiving channel 34, such channel extending upwardly into the upper base 6 from the upper base's lower surface. The annular engagement of ridge 32 with channel 34 prevents upper base 6 from sliding laterally over the upper surface of lower base 4 when mounted thereon, and facilitates rotary motion of the upper base 6 with respect to the lower base 4.

Figure 8:
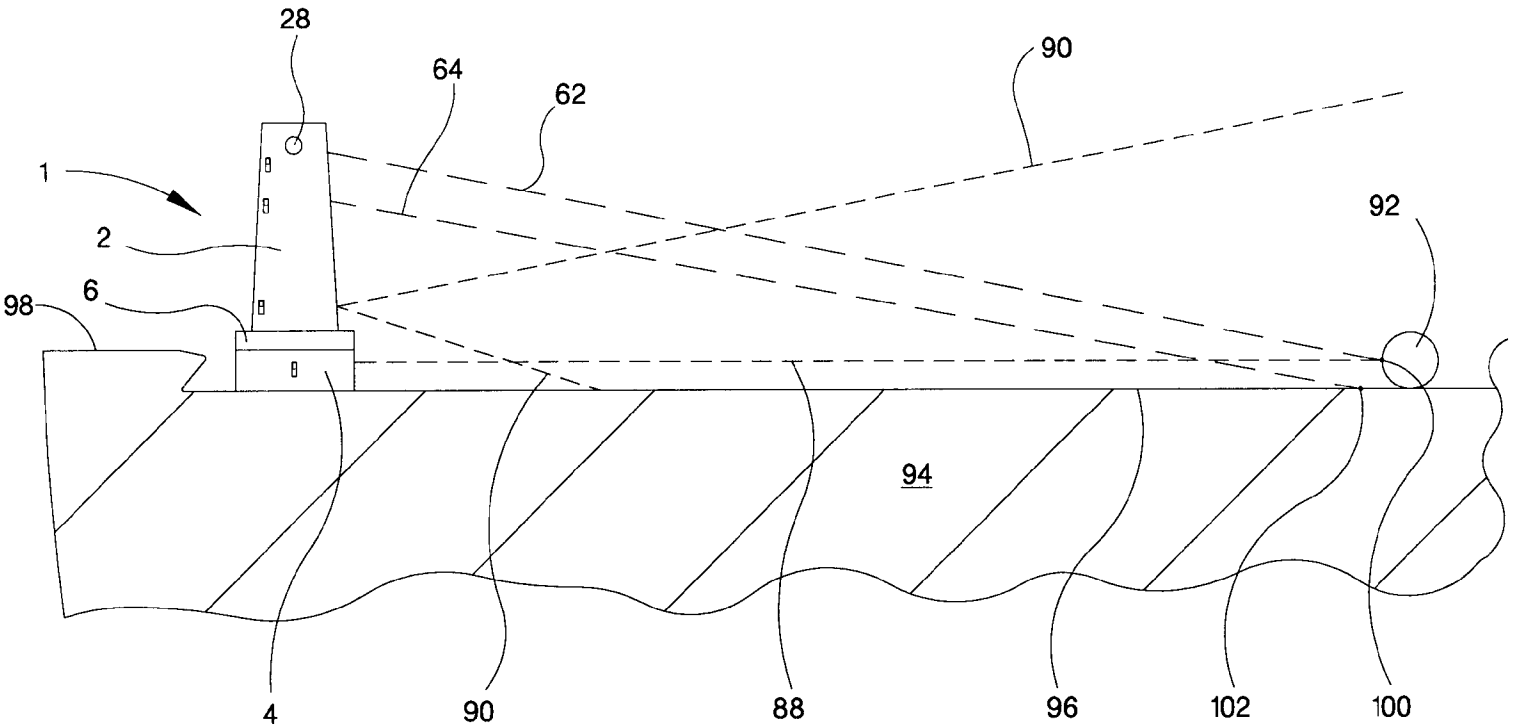
FIG. 8 representationally depicts use of the assembly of the instant invention upon a pool table, the view showing the pool table in a sectional side view.

Referring simultaneously to FIGS. 2 and 8, the vertical dimension of lower base 4 is preferably equal to the height of a pool table rail 98 over the table surface 96 of pool table 94, such sizing allowing the lower base 6 to be alternately placed upon the surface of rail 96 without altering the elevation of column 2.

Figure 4:
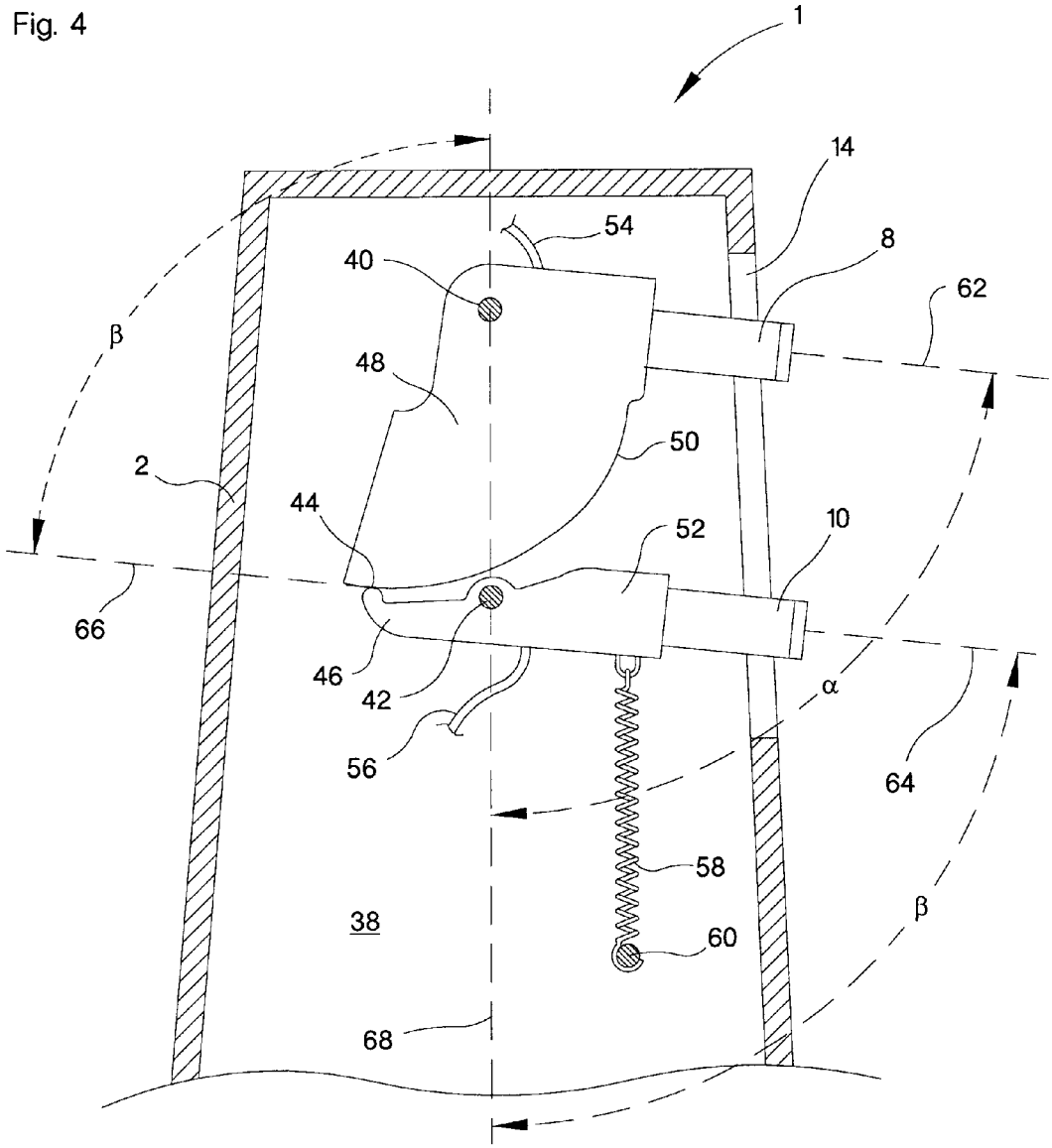
FIG. 4 is an upper partial sectional view as indicated in FIG. 1.
Figure 5:
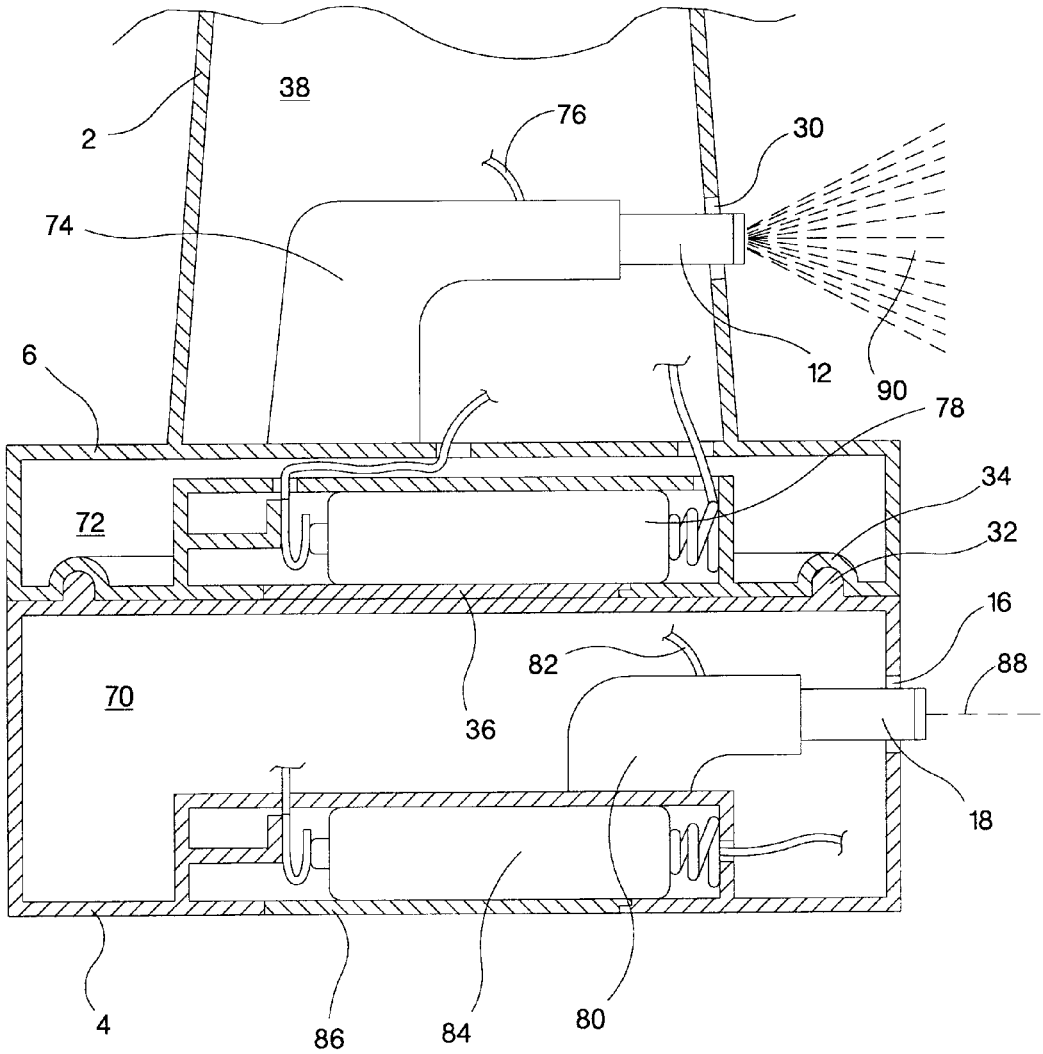
FIG. 5 is a lower partial sectional view as indicated in FIG. 1.

Referring simultaneously to FIGS. 1, 4, and 5, a ball spotting laser 8, a table spotting laser 10, and a vertical line drawing laser 12 are supported within the interior space 38 of columnar tower 2, the line drawing laser 12 having a vertically oriented fan beam collimation lens. Referring simultaneously to FIGS. 1 and 5, a second line drawing laser 18, similarly having a fan beam collimation lens, is supported within the interior space 70 of the lower base 4. Apertures 14 and 30 within the front wall of column 2 permit laser light emissions from such column, while aperture 16 within the wall of lower base 4 permits laser light emission therefrom.

Referring further to FIG. 1, slide switches 20, 22, 24, and 26 respectively control actuation of lasers 18, 12, 10, and 8, while knob 28 directly controls the angular orientation of ball spotting laser 8.

Figure 6:
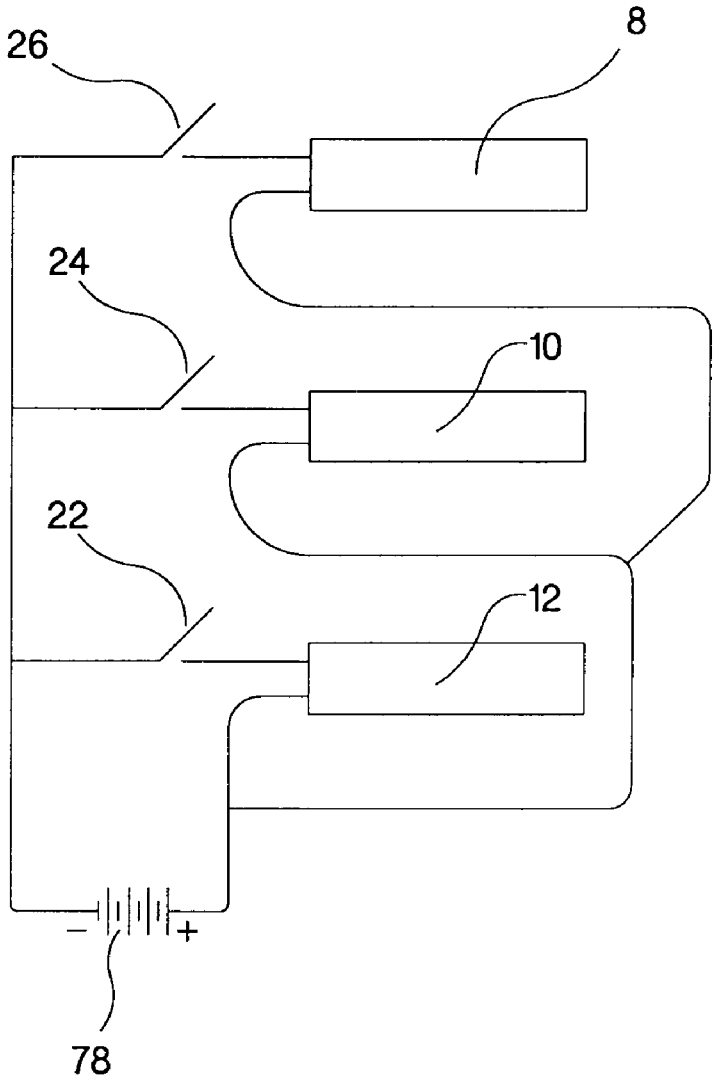
FIG. 6 is an electrical schematic drawing of electrical wiring and components integral with the upper frame structure depicted in FIG. 2.
Figure 7:
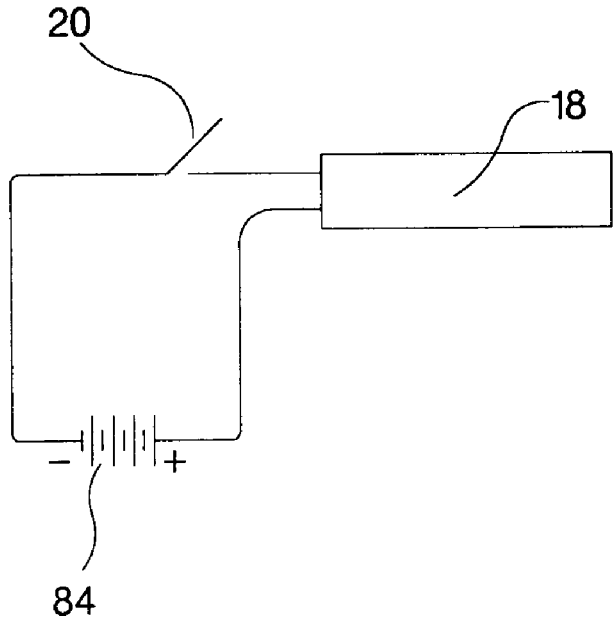
FIG. 7 is an electrical schematic drawing of electrical wiring and components integral with the lower frame structure depicted in FIG. 2.

Referring simultaneously to FIGS. 3, 4, 5, 6, and 7, lasers 8, 10, 12, and 18 respectively have electric power cords 54, 56, 76, and 82. Battery power assembly 78 housed within the interior space 72 of upper base 6 provides electrical power to lasers 8, 10, and 12 via power cords 54, 56, and 76 in a parallel circuit as depicted in FIG. 6. Similarly, battery assembly 84 housed within interior space 70 of lower base 4 powers laser 18 via power cord 82 according to the circuit depicted in FIG. 7. Referring simultaneously to FIGS. 3 and 5, batteries 78 and 84 are replaceable via battery compartment covers 36 and 86 as depicted in FIG. 3, such covers having slide latches 39.

Referring to FIG. 5, the vertical line drawing laser 12 is preferably fixedly positioned as depicted by fixed mount 74, and the horizontal line drawing laser 18 is similarly fixedly positioned as depicted by fixed mount 80.

Referring to FIG. 4, ball spotting and table spotting lasers 8 and 10 are respectively pivotally mounted within the interior space 38 of column 2 by axles 40 and 42, such axles spanning between and being supported by the side walls of column 2. The pivoting mount of the ball spotting laser 8 preferably comprises a cam 48 having a curved cam surface 50. The pivoting mount 52 of table spotting laser 10 preferably comprises a rearwardly extending lever arm 46 having a slide pin 44. Preferably, axles 40 and 42 are vertically aligned along vertical reference line 68. The rearwardly extending reference line 66 is co-linear with table spotting laser beam 64, and the center axle 42. As drawn in FIG. 4, the cam contact point of pin 44 is positioned upon said line 66. Suitably, such cam contact point may be alternately perpendicularly raised over line 66 for purposes of increasing clearances between the two pivotal mount assemblies.

Referring further to FIG. 4, a spring 58 downwardly biases the table spotting laser 10, the spring 58 being anchored by a laterally extending pin 60, such pin 60 spanning between and being anchored upon the side walls of columnar tower 2.

Referring simultaneously to FIGS. 1 and 4, knob 28 is operatively connected to an end of axle 40 which protrudes laterally outward from the side wall of columnar tower 2.

Upon rotation and counter-rotation of knob 28, cam 48 and ball spotting laser 8 rotate and counter-rotate about the axis of axle 40. Upon such rotation and counter-rotation, spring 58 urges slide pin 44 to remain in contact with cam surface 50 of cam 48, causing pivotal motion of the table spotting laser 10 to be controlled by the shape of cam surface 50.

Referring further to FIG. 4, the curve of cam surface 50 is preferably shaped so that upon rotation and counter-rotation of cam 48 about axle 40, the distance d between the contact point of slide pin 44 and the center of axle 40 is continuously defined by the following equation:

$$d = \sqrt{p^2 + L^2 + (b-t)^2 - 2\sqrt{p^2+L^2}\,(b-t)\cos\left(\tan^{-1}\left(\frac{(b-r)\tan\alpha - r}{t}\right) - \tan^{-1}\frac{p}{L}\right)}$$

where, referring simultaneously to FIGS. 4 and 8, L is equal to the lever arm distance between the center of axle 42 and the point on line 66 which perpendicularly underlies the contact point of slide pin 44 where "p" is the perpendicular distance from said point on line 66 to said contact point (as drawn, "p" equals zero), where b is the vertical distance from the pool table's surface 96 to the center of axle 40, where t is the vertical distance from table surface 96 to the center of axle 42, where r is the length of the spherical radius of pool ball 92, and where α is the angle between vertical reference line 68 and ball spotting laser beam 62.

Figure 9:
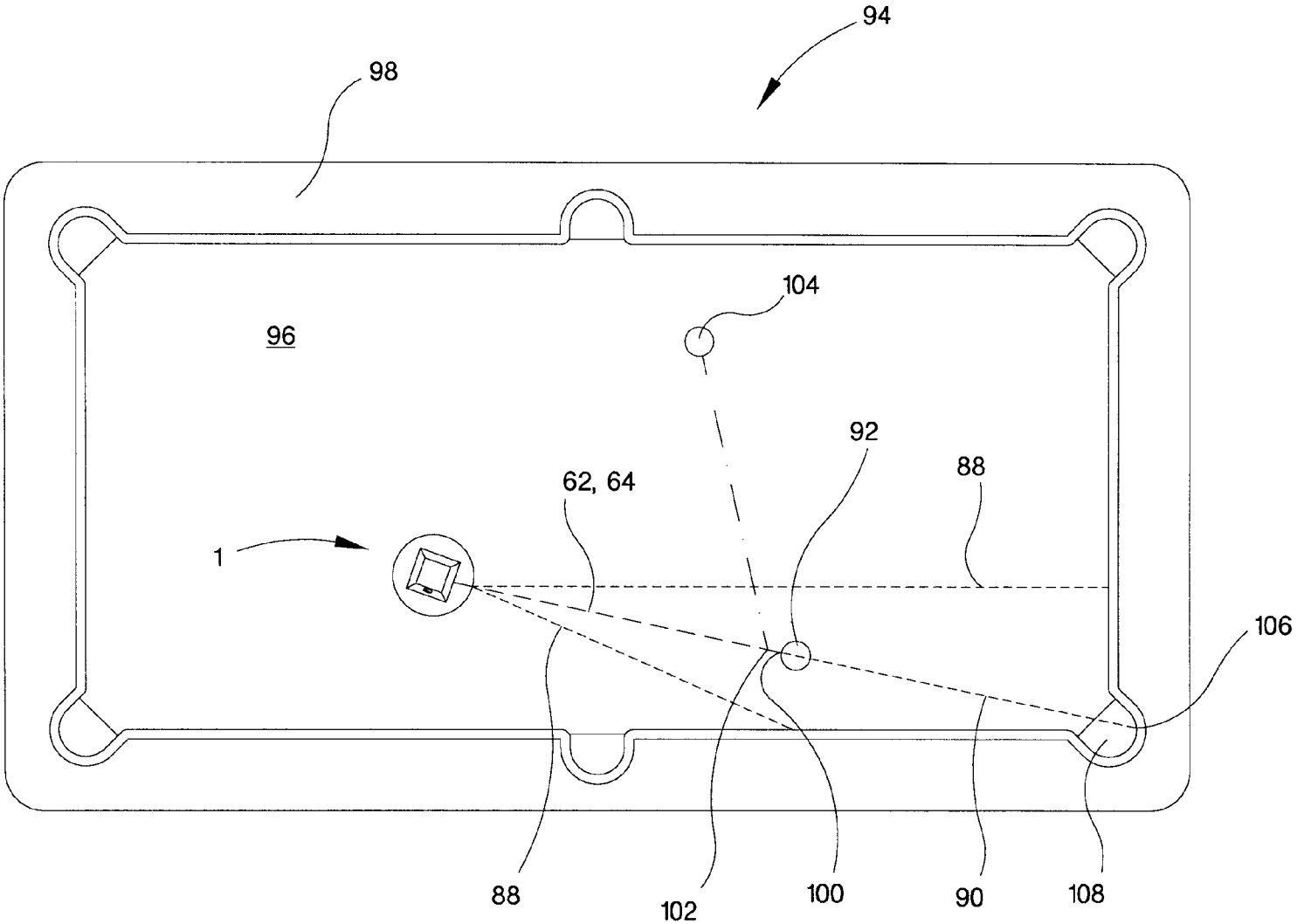
FIG. 9 representationally depicts use of the instant inventive assembly upon the pool table of FIG. 8, shown in plan view.

In use of the instant inventive assembly 1, referring simultaneously to FIGS. 1, 4, 5, 8, and 9, the assembly 1 is placed upon the table surface 96 of the pool table 94 as indicated in FIGS. 8 and 9. Switch 22 is moved to its "on" position, actuating line drawing laser 12, and causing its vertically oriented fan beam collimation lens to cast a vertically oriented fan beam represented by dashed lines 90. As indicated in FIG. 9, the assembly 1 is aligned upon table surface 96 so that fan beam 90 appears to vertically bisect pool ball 92, and so that fan beam 90 illuminates a point 106 on the back wall of pocket 108. Thereafter, switch 20 is moved to its "on" position actuating horizontal line drawing laser 18, and causing its horizontally oriented fan beam collimation lens to cast a horizontally oriented fan beam 88. The intersection of illuminated lines drawn by the vertically oriented fan beam 90 and the horizontally oriented fan beam 88 upon the surface of ball 92 pre-illuminates the ball strike point 100. Thereafter, knob 28 is manually rotated clockwise or counter-clockwise, sweeping ball spotting beam 62 within a vertical plane until said beam further illuminates the previously illuminated ball strike point 100. Upon such further illumination of ball strike point 100, table spotting laser beam 64 automatically illuminates cut shot target point 102 resulting from the pivotal motion guiding actions of the curved cam surface 50, lever arm 46, and spring 58.

Upon such illumination of cut shot target point 102, switches 22 and 20 may be moved to their "off" position, deactivating line drawing lasers 12 and 18. Similarly, switch 26 may be moved to its "off" position, deactivating ball spotting laser 8. Acceptably, all lasers may alternately remain on at all times. Thereafter, cue ball 104 is struck with a pool cue, causing cue ball 104 to roll along a line directly over cut shot target point 102, causing the cue ball 104 to strike pool ball 92 at ball strike point 100, and causing pool ball 92 to roll into pocket 108.

Figure 10:
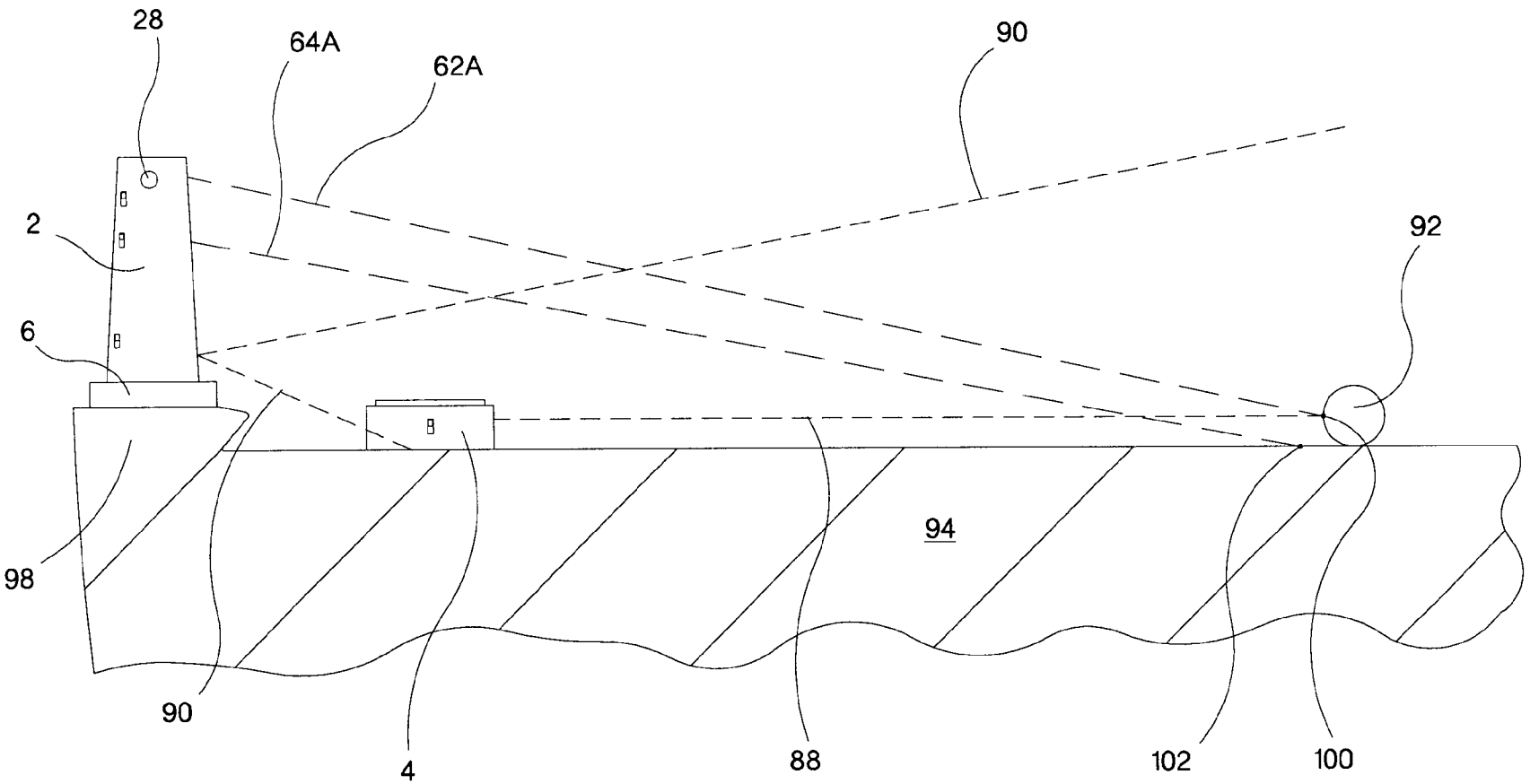
FIG. 10 redepicts FIG. 8, showing an alternate configuration of the assembly.

For convenience of alternate positioning, the upper base 6 may be placed upon rail 98 rather than upon lower base 4 as depicted in FIG. 10, reference numerals 62A and 64A signifying alternately swept ball spotting and table spotting light beams.

Figure 11:
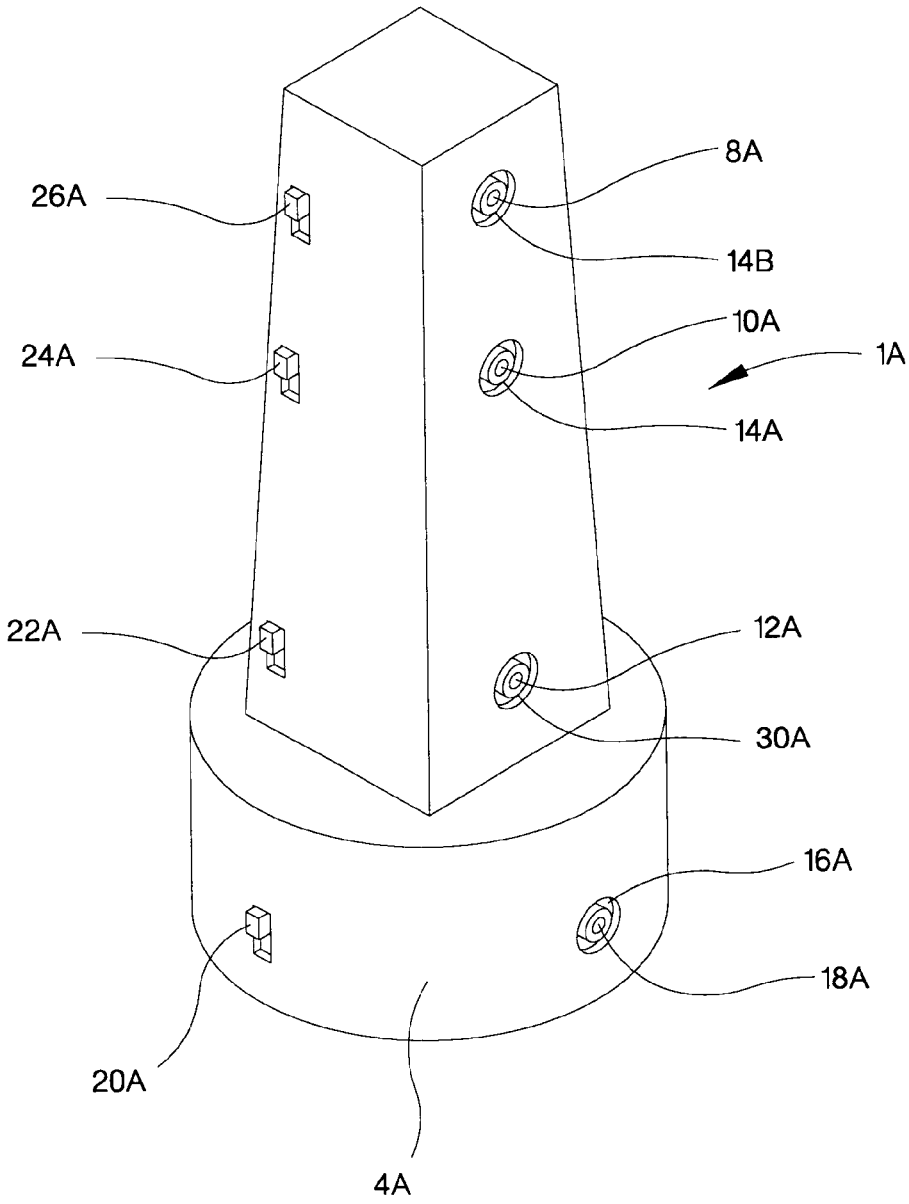
FIG. 11 depicts an alternate configuration of the assembly depicted in FIG. 1.

Structures identified by reference numerals having the suffix "A" appearing in the alternately configured assembly of FIG. 11 perform functions similar to the functions of similarly labeled structures appearing in FIG. 1. Ball spotting laser 8A and table spotting laser 10A of the assembly of FIG. 11 are fixedly and rigidly positioned with respect to the column, as opposed to the cam controlled pivot mounts depicted in FIG. 4. Thus, the assembly of FIG. 11 rigidly secures ball spotting and table spotting lasers 8A and 10A in a single configuration similar to that depicted in FIG. 4. Referring to FIG. 5, fixed mounts similar to mounts 74 and 80 may be utilized for such fixed positioning of ball spotting and table spotting lasers 8A and 10A. Referring simultaneously to FIGS. 4 and 11, and assuming that the depicted positions of ball spotting and table spotting lasers 8 and 10 are representative of the fixed positions of ball spotting and table spotting lasers 8A and 10A, the angular displacement β of table spotting light beam 64 from vertical line 68 may be expressed in terms of α, i.e., the angular displacement of the ball spotting light beam 62, according to the following equation:

$$\beta = \tan^{-1}\left(\frac{(b-r)\tan\alpha - r}{t}\right),$$

and conversely, the angle α may be expressed in terms of β according to the following equation:

$$\alpha = \tan^{-1}\left(\frac{t\tan\beta + r}{b-r}\right)$$

Provided that the ball spotting and table spotting lasers 8A and 10A are oriented in accordance with the above equations, the knob turning/ball spotting step described above may be effectively performed by alternately moving the frame forwardly toward the pool ball or rearwardly away from the pool ball until the ball spotting laser illuminates the ball strike point. Upon such illumination, the table spotting laser will automatically illuminate the cut shot target point.

While the principles of the invention have been made clear in the above illustrative embodiment, those skilled in the art may make modifications in the structure, arrangement, portions, components, and method steps of the invention without departing from those principles. Accordingly, it is intended that the description and drawings be interpreted as illustrative and not in the limiting sense, and that the invention be given a scope commensurate with the appended claims.

We claim:

1. An assembly for illuminating a cut shot target point upon a pool table having a table surface, the surface having a surface elevation, the pool table having a rail, the rail having a rail elevation overlying the surface elevation, the pool table having a pool ball positioned at a resting point upon the table surface, the pool ball having a ball surface, having a radius r, and having a diameter, the pool table having a pocket positioned forwardly from the pool ball, the cut shot target point being positioned on the table surface and on a line extending rearwardly from the resting point, the cut shot target point being further positioned a distance away from the resting point, said distance being equal to said diameter, the apparatus comprising:

(a) a ball spotting light beam emitter capable of illuminating a ball strike point upon the ball surface, the ball strike point being within a vertical plane, said plane vertically bisecting the pool ball, said plane extending forwardly to intersect the pocket;

(b) a table spotting light beam emitter; and (c) light beam pointing means operatively connected to the ball spotting and table spotting light beam emitters, the light beam pointing means being capable of, upon illumination by the ball spotting light beam emitter of the ball strike point, automatically pointing the table spotting light beam emitter toward the cut shot target point.

2. The assembly of claim 1 wherein the light beam pointing means comprises a frame capable of positioning the ball spotting and table spotting light beam emitters so that the ball spotting light beam emitter has an elevation b over the surface elevation, so that the table spotting light beam emitter has an elevation t over the surface elevation, so that the table spotting light beam emitter is in vertical alignment with or has a forwardly positive or rearwardly negative offset o away from a vertical line extending through the ball spotting light beam emitter, so that a light beam emitted by the ball spotting light beam emitter extends at an acute angle away from the vertical line extending through the ball spotting light beam emitter, and so that a light beam emitted by the table spotting light beam emitter extends at another acute angle away from a vertical line extending through the table spotting light beam emitter, said angles comprising at least a first pair of angles, each angle among the at least first pair of angles being related to the other angle of such pair according to a first equation:

$$angle = \tan^{-1}\left(\frac{(b-r)\tan(otherangle) - r - o}{t}\right), \text{ or}$$

according to a second equation:

$$angle = \tan^{-1}\left(\frac{t\tan(otherangle) + r + o}{b-r}\right).$$

3. The assembly of claim 2 wherein the light beam pointing means comprises pivot mounts, and further comprising a variable motion linkage capable of alternately positioning the ball spotting and table spotting light beam emitters so that light beams emitted by the ball spotting and table spotting emitters may extend in a multiplicity of second pairs of acute angles away from said vertical lines, the angles among each pair of angles among said multiplicity of second pairs of acute angles being related to each other according to the first or second equations.

4. The assembly of claim 3 wherein the variable motion linkage comprises a sub-assembly selected from the group consisting of cam and slide pin assemblies, slide track and slide block assemblies, roller track and roller assemblies, slide slot and slide pin assemblies, paired non-circular gears, paired non-circular friction wheels, and computer controlled servo motors.

5. The assembly of claim 4 wherein the ball spotting and table spotting light beam emitters comprise lasers.

6. The assembly of claim 1 further comprising means for pre-illuminating the ball strike point, said means comprising a first line drawing laser having a first fan beam collimation lens; first positioning means capable of orienting the first line drawing laser so that a fan beam emitted from the first fan beam collimation lens may horizontally bisect the pool ball; a second line drawing laser having a second fan beam collimation lens, and second positioning means capable of orienting the second line drawing laser so that a fan beam emitted from the second fan beam collimation lens may simultaneously vertically bisect the pool ball and intersect the pocket.

7. The assembly of claim 6 wherein the second positioning means comprises a first frame, said frame supporting the ball spotting and table spotting light beam emitters.

8. The assembly of claim 7 wherein the first positioning means comprises a second frame, the second frame having a vertical dimension equal to the rail elevation, the first frame being capable of alternately resting upon the rail or upon the second frame.

* * * * *